US010550504B2

(12) United States Patent
Lv et al.

(10) Patent No.: US 10,550,504 B2
(45) Date of Patent: Feb. 4, 2020

(54) SELF-CLEANING WASHING MACHINE

(71) Applicant: QINGDAO HAIER WASHING MACHINE CO., LTD., Qingdao, Shandong (CN)

(72) Inventors: Peishi Lv, Shandong (CN); Lin Yang, Shandong (CN); Yun Tian, Shandong (CN); Feng Li, Shandong (CN); Qi Zhang, Shandong (CN)

(73) Assignee: QINGDAO HAIER WASHING MACHINE CO., LTD., Qingdao, Shandong (CN)

( * ) Notice: Subject to any disclaimer, the term of this patent is extended or adjusted under 35 U.S.C. 154(b) by 266 days.

(21) Appl. No.: 15/543,470

(22) PCT Filed: Jul. 3, 2015

(86) PCT No.: PCT/CN2015/083256

§ 371 (c)(1),
(2) Date: Jul. 13, 2017

(87) PCT Pub. No.: WO2016/112658

PCT Pub. Date: Jul. 21, 2016

(65) Prior Publication Data

US 2017/0362760 A1 Dec. 21, 2017

(30) Foreign Application Priority Data

Jan. 16, 2015 (CN) ..... 2015 1 0021437

(51) Int. Cl.
*D06F 35/00* (2006.01)
*D06F 39/08* (2006.01)
*D06F 39/10* (2006.01)

(52) U.S. Cl.
CPC ..... *D06F 35/008* (2013.01); *D06F 39/083* (2013.01); *D06F 39/10* (2013.01)

(58) Field of Classification Search
CPC ..... D06F 35/00; D06F 35/008; D06F 39/083; D06F 39/10
(Continued)

(56) References Cited

U.S. PATENT DOCUMENTS

2012/0125056 A1* 5/2012 Bondi ..... G06F 39/086 68/18 F
2015/0009633 A1 1/2015 Chen et al.

FOREIGN PATENT DOCUMENTS

CN 201358374 Y 12/2009
CN 102733145 A 10/2012
(Continued)

OTHER PUBLICATIONS

CN102733156A—machine translation (Year: 2012).*
(Continued)

*Primary Examiner* — Michael E Barr
*Assistant Examiner* — Tinsae B Ayalew
(74) *Attorney, Agent, or Firm* — Buchanan Ingersoll & Rooney PC

(57) ABSTRACT

A self-cleaning washing machine includes an outer tub and an inner tub, a chamber between the outer tub and the inner tub is provided with cleaning particles for cleaning the inner wall of the outer tub and the outer wall of the inner tub, an accommodating chamber for collecting the cleaning particles is connected to a drainage outlet of the outer tub; a shield cover arranged at the drainage outlet rises or falls with the change of the water level in the washing machine or the control device to open or at least partially close the drainage outlet so that the cleaning particles flow into the chamber or back into the accommodating chamber. By setting the shield cover, the cleaning particles are not sucked out from the
(Continued)

accommodating chamber and enter between the inner tub and the outer tub to avoid noise when the washing machine is dewatering.

20 Claims, 7 Drawing Sheets

(58) Field of Classification Search
USPC ..... 68/13 R
See application file for complete search history.

(56) References Cited

FOREIGN PATENT DOCUMENTS

| | | | |
|---|---|---|---|
| CN | 102733156 | A | 10/2012 |
| CN | 102978870 | A | 3/2013 |

OTHER PUBLICATIONS

International Search Report (PCT/ISA/210) dated Aug. 26, 2015, by the State Intellectual Property Office of the P.R. China as the International Searching Authority for International Application No. PCT/CN2015/083256.
Written Opinion (PCT/ISA/237) dated Aug. 26, 2015, by the State Intellectual Property Office of the P.R. China as the International Searching Authority for International Application No. PCT/CN2015/083256.

* cited by examiner

SELF-CLEANING WASHING MACHINE

FIELD OF THE INVENTION

The present disclosure relates generally to a field of a washing machine, and more particularly, to a self-cleaning washing machine which automatically cleans the inner and outer walls by using the cleaning particles with the water flow between the inner tub and the outer tub. And more particularly, it relates to a self-cleaning washing machine with storage device which can collect cleaning particles.

BACKGROUND OF THE INVENTION

The space between the inner tub and the outer tub of the existing pulsator washing machine is a closed environment, which only the water flow can pass through. Due to the limitations of the above structure of the washing machine and the specialty of the using environment, the outer wall of the inner tub and the inner wall of the outer tub will be adhered the dirt after using for 3-5 months. So that breeds different degrees of bacteria, and the vast majority of bacteria are harmful to the human body.

With the improvement of people's living standard and the improvement of the quality of life, it is urgent to solve the hygienic problems of washing machines. The investigation for the internal environment of the washing machine by the related research institutions shows that the seriousness of the pollution inside the washing machine has been paid more and more attention by the consumers. In order to fundamentally avoid the secondary contamination of the washing machine on the washing, and be better responsible for the health of the users, the cleaning of the interior of the washing machine has become an urgent problem to be overcome.

A Chinese patent No. 200820183308.4 discloses a barrel washing machine with cleaning a space between barrels, which comprises an inner tub, an outer tub and a plurality of round silicone balls for cleaning the walls of the inner tub and the outer tub. Using the rotation of the inner tub during the laundry to drive the water flow, thereby, the water flow drives the silicone balls between the inner tub and the outer tub of the washing machine to move and the walls of the inner and the outer tubs can be continuously collided. That is to achieve the purpose of cleaning the walls of the inner tub and the outer tub.

However, in the structure of the above-mentioned washing machine, after the drainage, the rubber ball or flexible particles freely scatter in the tub in the high-speed dewatering process, which will produce a lot of noise, increase the energy consumption of washing machines, and affects the life of the washing machine.

Therefore, it is necessary to provide an accommodating chamber for the rubber balls or flexible particles on the washing machine so that the rubber balls or the flexible particles are able to move between the inner tub and the outer tub during the washing process with the water flow to clean the tub walls; and are stored in the accommodating chamber during the dewatering process to reduce the noise generated during dewatering.

However, how to set up the accommodating chamber on the washing machine and how to make the accommodating chamber be open and closed changing with the washing machine program becomes an urgent problem to be solved.

In view of foregoing, the disclosure is proposed.

SUMMARY OF THE INVENTION

The technical problem to be solved by the present disclosure is to overcome the shortcomings of the prior art and to provide a self-cleaning washing machine having a function of cleaning the tub walls by the cleaning particles between the inner tub and the outer tub.

Another object of the present disclosure is to provide a shield cover that prevents the cleaning particles from entering the space between the inner tub and the outer tub when the washing machine dewaters.

In order to solve the technical problem, the basic idea of the technical scheme adopted by the disclosure is that:

A self-cleaning washing machine, the washing machine comprises an outer tub and an inner tub, a chamber between the outer tub and the inner tub which is provided with cleaning particles for cleaning the inner wall of the outer tub and the outer wall of the inner tub. An accommodating chamber for collecting the cleaning particles is connected to a drainage outlet of the outer tub. A shield cover is arranged at the drainage outlet, the shield cover rises or falls with the change of the water level in the washing machine or by the effect of a control device to open or at least partially close the drainage outlet so that the cleaning particles controllably flows into the chamber or back into the accommodating chamber.

Further, a body of the shield cover is provided with or connected with a hollow part which is set independently, and the hollow part forms a buoyancy chamber. A density of the shield cover is lower than a density of the washing water, or the shield cover is provided with a hollow buoyancy chamber which provides a floating force so that the shield cover can rise with the rise of the water level or fall with the drop of the water level in the outer tub 3.

Further, the shield cover includes a cover plate covering the drainage outlet. The lower side of the cover plate is provided with a projecting part. When the cover plate rises, the projecting part is at least partially in the drainage outlet to limit the horizontal position of the cover plate.

Preferably, the lower end of the projecting part is provided with a buckle with horizontal projection, the buckle is matched with the drainage outlet and is clamped. The distance between the buckle and the cover plate is smaller than the clearance between the bottom of the inner tub and the bottom of the outer tub, and is larger than the diameter of the cleaning particles.

It is further preferred that, the projecting part includes at least two limit bars extending vertically downward below the cover plate, and the lower end of the limit bar is provided with an outwardly projecting buckle. And the buckle is matched with the outer circumference of the drainage outlet and is clamped, so that the cover plate can be raised by a height relative to the outer tub for the cleaning particles to flow out or into the accommodating chamber 1.

Further, the buoyancy chamber is sealed or opened only at the lower end, so that the buoyancy chamber is filled with air and provides the floating force for the shield cover when the washing machine washing or rinsing.

Further, the shield cover includes a sleeve with a hollow, the hollow part of the sleeve constitutes the buoyancy chamber; the sleeve is arranged below the cover plate. The upper end of the sleeve is sealed and the lower end is open.

Preferably, the sleeve is disposed coaxially with the cover plate, and the sleeve extends vertically.

Further, a gap for the washing water in the outer tub flowing into the accommodating chamber is arranged between the cover plate and the outer tub and/or on the cover plate. Thus, when the shield cover is lowered at the drainage outlet, the wash water in the outer tub can still flow into the accommodating chamber to ensure that the wash water in the outer tub can be completely discharged through the drainage outlet. At the same time, the washing water generates an upward buoyancy to the buoyancy chamber to drive the shield cover to rise. This avoids the situation occurring in which the shield cover closes the drainage outlet completely, and the washing water cannot flow into the accommodating chamber, the buoyancy chamber cannot provide buoyancy, and the shield cover cannot rise and open.

Further, a supporting rib is arranged at the outer periphery of the cover plate so that the cover plate is supported above the drainage outlet by the supporting rib. A gap for the washing water in the outer tub flowing into the accommodating chamber is arranged between the cover plate and the outer tub.

Preferably, the outer periphery of the cover plate is provided with a plurality of supporting ribs extending radially along the cover plate, and the support ribs are protruded from the periphery of the drainage outlet. The supporting rib is greater thickness than the cover plate, and the lower side of the supporting ribs are protruded from the lower side of the cover plate. So the cover plate is provided at a certain distance from the drainage outlet under the support of the support ribs to form a gap for the washing water flowing into the accommodating chamber.

Further, the adjacent supporting ribs are spaced at a certain angle, the distance between the adjacent support ribs is smaller than the diameter of the cleaning particles 6.

Preferably, the supporting rib is wedge-shaped, a height of the supporting rib is gradually decreased outwardly from the outer side of the cover plate, and the lower side of the supporting rib is inclined. An outer tub portion at the drainage outlet has a tapered surface that is tapered from top to bottom matching with the underside of the supporting rib.

Further, the shield cover is connected with a screw vertically provided. The washing machine is also provided with a control motor; the output end of the control motor is engaged by thread with the screw in order to make the shield cover rise or fall with the rotation of the output of the control motor.

Further, the washing machine also includes a drainage structure, the drainage structure comprises a drainage pipe communicated with the accommodating chamber. The connection between the drainage pipe and the accommodating chamber is provided with a filtering mechanism for preventing the cleaning particles from flowing out.

In the present invention, the specific working procedures of the washing machine when executing different programs are as follows:

1. When the water supplies water into the washing machine, the water is fed into the outer tub, and the water level of the washing water is raised to drive the shield cover to rise. At least part of the drainage outlet is opened so that the cleaning particles flow into the space between the inner tub and the outer tub through the drainage outlet. Preferably, in the process, the washing water flows into the accommodating chamber and at the same time the buoyancy chamber is still filled with air because the buoyancy chamber is open only at the lower end, which provides a floating force for the shield cover.

2. When the washing machine is draining, the water level of the washing water is lower and drives the shield cover down, and the cleaning particles are returned to the accommodating chamber with the water flow through the drainage outlet.

3. When the washing machine is dewatering, the shield cover is placed at the drainage outlet, and the cleaning particles are in the accommodating chamber.

The cleaning particles of the present disclosure can float between the inner tub and the outer tub and impact the walls of the inner and outer tubs along with the water flow during the washing process, and the walls of tubs are cleaned by the cleaning particles striking and rubbing the walls of the inner and outer tubs. After the cleaning, the cleaning particles flow into the accommodating chamber with the draining water during the drainage process. When the water is fed in rinsing or next washing, the cleaning particles float out of the accommodating chamber with the supplied water level rising and flow into between the inner tub and the outer tub.

The cleaning particles are arranged between the inner tub and the outer tub for cleaning the walls of the inner tub and the outer tub, so that it will not stick dirt and breed bacteria. The cleaning particles can be sponge material or rubber or plastic foam, such as foam rubber, foam plastic, foam composite polyurethane. It is preferable to use an adsorbent material for cleaning the tub walls better. The cleaning particles need to have a certain degree of elasticity, a lower density than water in dry state, can be soaked in water, cheap price and strong abrasion resistance.

The cleaning particles are spherical, square, elliptical, cylindrical, tetrahedron or other irregular agglomerated particulate matter, the number of which is 3 to 50, which has lower density than water and a certain elasticity and abrasion resistance.

According to the above-mentioned technical solution, the present disclosure has the following advantageous effects as compared with the prior art.

The self-cleaning washing machine of the present disclosure is provided with cleaning particles for cleaning the tub walls, and at the drainage outlet is provided with a shield cover for preventing the cleaning particles from flowing into between the inner tub and the outer tub when the washing machine is dewatering, so that the cleaning particles are not sucked out from the accommodating chamber with high-speed rotation of the inner tub and enter between the inner tub and the outer tub, to avoid noise.

In the present disclosure, the material of the shield cover has a smaller density than that of the water so that the shield cover can be automatically raised or lowered as the washing water level. At the same time, a hollow buoyancy chamber is provided on the shield cover to reduce the overall density of the shield cover, so that the shield cover can also automatically rise or fall as the washing water level. More specifically, the buoyancy chamber is consisted of a sleeve which is sealed at the upper end and open at the lower end so that the buoyancy chamber is still filled with air under the influence of the pressure difference during the washing or rinsing of the washing machine to ensure the floating force for the shield cover.

During the washing process of the washing machine of the present disclosure, the water between the inner tub and the outer tub is exchanged with the water in the inner tub, and the water flow is formed due to the forward and reverse rotation of the impeller or the inner tub and drives the cleaning particles which is placed between the inner tub and the outer tub to whirl in the water, collide and rub the walls of the inner and outer tubs. At the same time under the auxiliary action of water immersion, the attachment attached on the walls of the inner and outer tubs and the bottom of the inner tub are cleaned, that can fundamentally prevent the generation of dirt, put an end to the breeding of bacteria. The user also cleans the inner and outer tubs while washing the clothes, it has the benefit of washing and cleaning at any time without leaving any dirt, clean and safe.

The following is further described in details with embodiments of the present disclosure.

Figure 1:
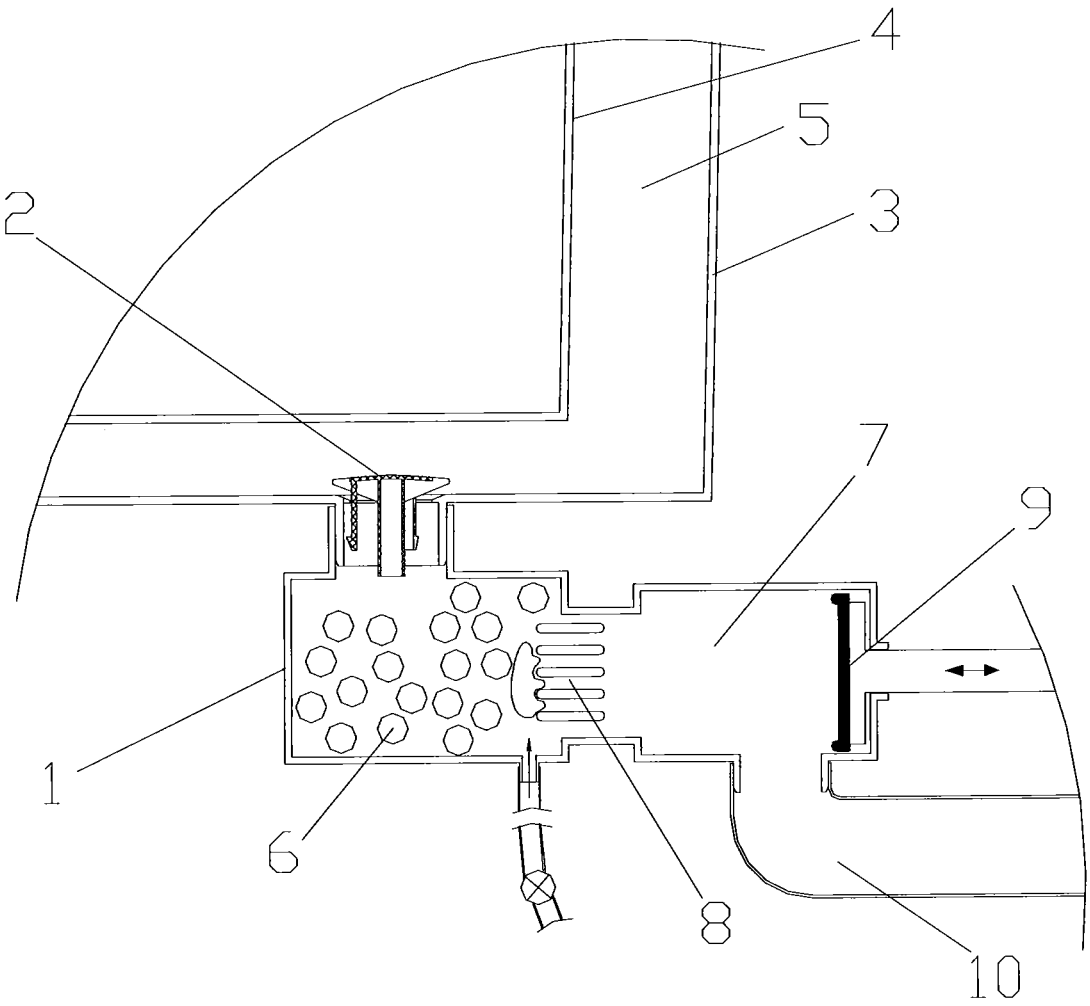
FIG. 1: A structural schematic diagram of a part of a washing machine in dewatering or non-operation state of the present disclosure.

Major component description: 1—accommodating chamber, 2—shield cover, 3—outer tub, 4—inner tub, 5—chamber, 6—cleaning particle, 7—drainage chamber, 8—filtering mechanism, 9—drainage valve, 10—drainage pipe, 20—buoyancy chamber, 21—cover plate, 22—supporting rib, 23—sleeve, 24—buckle, 25—opening, 26—limit bar, 27—control motor, 28—screw, 29—projecting part, 31—drainage outlet.

DETAILED DESCRIPTION OF THE INVENTION

As shown in Figures from 1 to 7, a self-cleaning washing machine according to the present disclosure, comprises an outer tub 3 and an inner tub 4, a chamber 5 between the outer tub 3 and the inner tub 4 is provided with cleaning particles 6 for cleaning the inner wall of the outer tub and the outer wall of the inner tub. The bottom of the outer tub 3 is provided with a drainage outlet 31, an accommodating chamber 1 for collecting the cleaning particles is connected to the drainage outlet 31. A shield cover 2 is arranged at the drainage outlet, the shield cover 2 rises or falls with the change of the water level in the washing machine to open or at least partially close the drainage outlet 31 so that the cleaning particles 6 controllably flow into the chamber 5 or back into the accommodating chamber 1.

In the present disclosure, the specific working conditions of the shield cover when the washing machine executes the different programs are as follows:

1. When the water is supplied into the washing machine, the water level of the washing water is raised to drive the shield cover to rise until at least part of the drainage outlet is opened, so that the cleaning particles flow into the space between the inner tub and the outer tub through the drainage outlet.

2. When the washing machine drains, the water level of the washing water is lowered and the shield cover falls, and the cleaning particles flow back to the accommodating chamber with the water flow through the drainage outlet.

3. When the washing machine is dewatering or not working, the shield cover is placed at the drainage outlet, and the cleaning particles are collected in the accommodating chamber.

By providing the shield cover, the cleaning particles in the accommodating chamber are not sucked out from the accommodating chamber and enter into the space between the inner tub and the outer tub as the inner tub rotates with high-speed, when the washing machine dewaters. Therefore, the noise is avoided.

Embodiment 1

Figure 4:
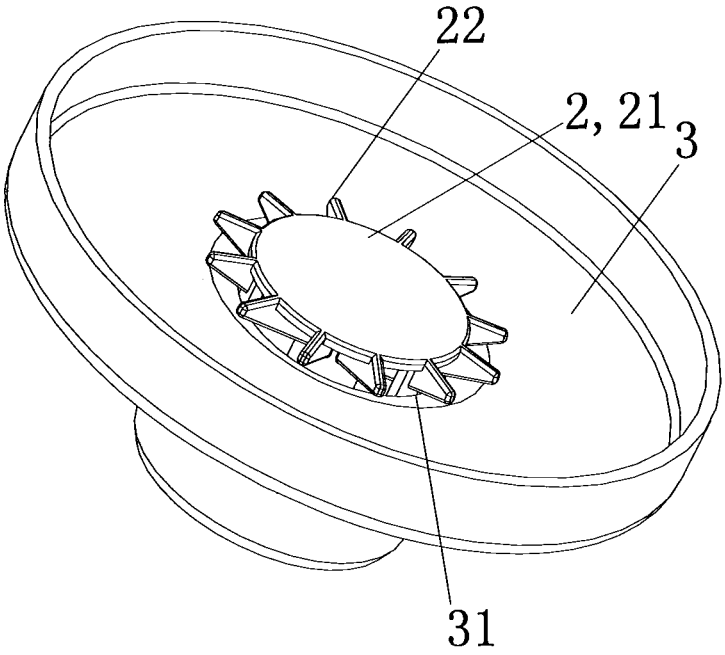
FIG. 4: A structural schematic diagram of a shield cover in a closed state of the present disclosure.
Figure 5:
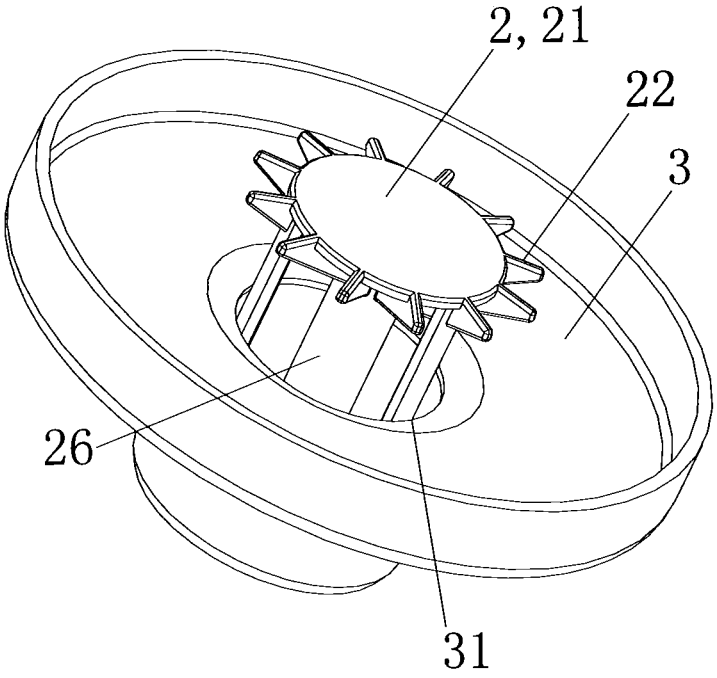
FIG. 5: A structural schematic diagram of the shield cover in an opening state of the present disclosure.

As shown in FIGS. 4 and 5, in the present embodiment, the shield cover 2 includes a cover plate 21 covering the drainage outlet. A density of the cover plate 21 is lower than the density of the washing water, so that the shield cover 2 can rise with the rise of the water level or fall with the lower of the water level in the outer tub 3. Thus, the shield cover 2 can rise with the washing water level during the washing or rinsing of the washing machine, the cleaning particles 6 flow into the chamber 5 between the inner tub and the outer tub. When the washing machine is dewatering, the shield cover is placed at the drainage outlet 31 so that the cleaning particles 6 are stored in the accommodating chamber 1 to avoid collision with the tub walls.

Embodiment 2

As shown in from FIG. 1 to FIG. 6, in the present embodiment, the shield cover 2 is provided with a buoyancy chamber 20 which is hollow and provides a floating force to reduce the overall density of the shield cover 2. By providing the buoyancy chamber on the shield cover, the shield cover made of a larger density material can still rise or fall with the rise or fall of the water level of the washing water in the outer tub.

In the present embodiment, the buoyancy chamber 20 is sealed or only the lower end of the buoyancy chamber 20 is communicated with the accommodating chamber 1 so that the buoyancy chamber 20 is filled with air when the washing machine washes or rinses to provide a floating force for the shield cover 2.

Figure 3:
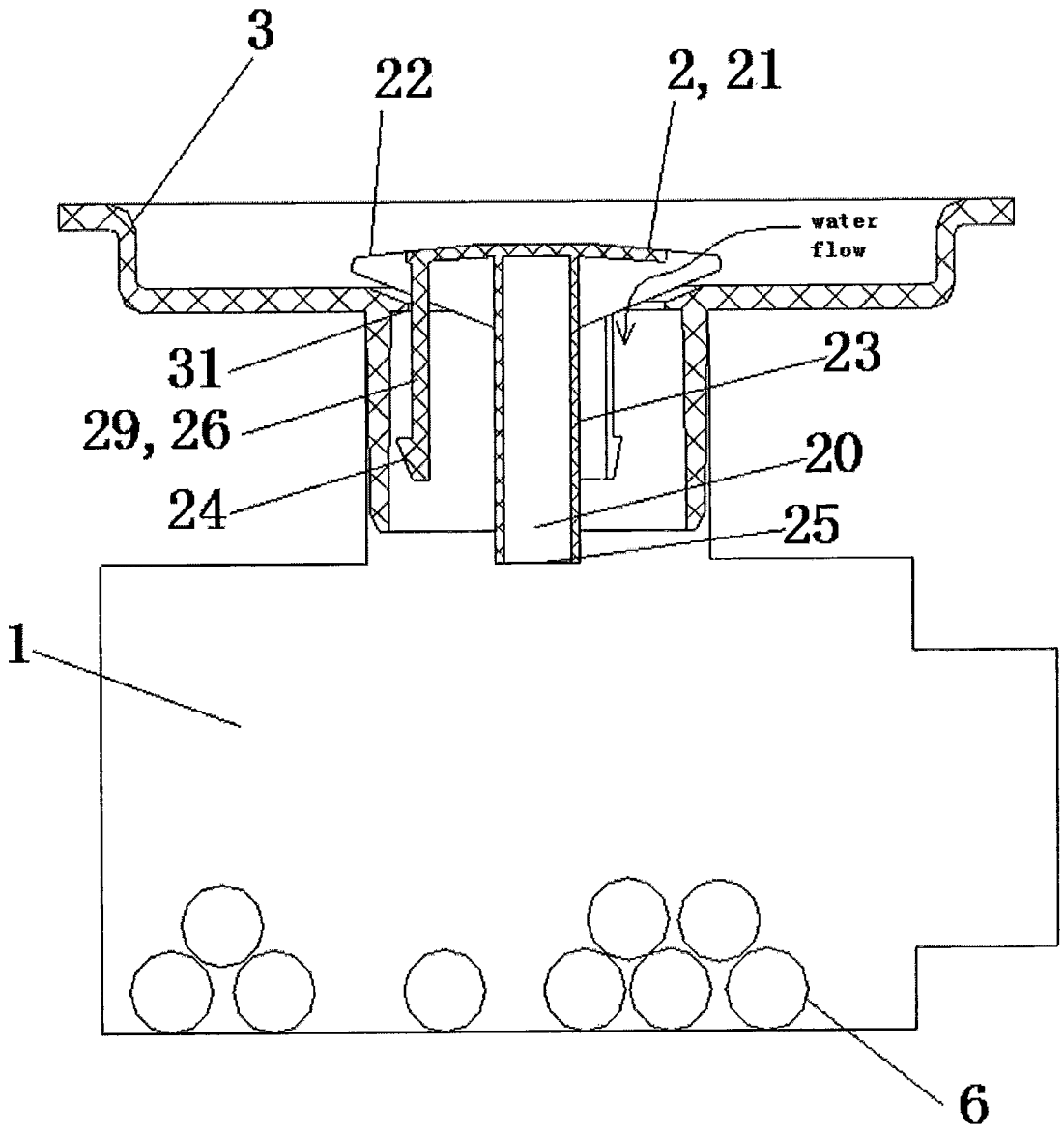
FIG. 3: A structural schematic diagram of a storage device for collecting cleaning particles in an embodiment of the present disclosure.

As shown in FIG. 3, the shield cover 2 includes a hollow sleeve 23, the hollow part of the sleeve 23 constitutes the buoyancy chamber 20. The sleeve 23 is arranged under the cover plate 21, and the sleeve 23 is in the accommodating chamber 1 when the shield cover 2 is placed at the drainage outlet. The upper end of the sleeve 23 is connected to the cover plate 21 to seal the upper end; the lower end of the sleeve 23 is provided with an opening 25 so that the buoyancy chamber 20 is communicated with the accommodating chamber 1 only through the opening 25 at the lower end of the sleeve 23. Thus, when washing water flows into the accommodating chamber, the buoyancy chamber is still filled with air under pressure to reduce the overall density of the shield cover and provide an upward buoyancy for the shield cover.

Preferably, the sleeve 23 is disposed coaxially with the cover plate 21, and the sleeve 23 extends vertically.

Embodiment 3

In the present embodiment, in order to allow the washing water in the outer tub to flow into the accommodating chamber, a supporting rib 22 is arranged at the outer periphery of the cover plate 21 so that the cover plate 21 is supported above the drainage outlet 31 by the supporting rib 22; a gap for the washing water in the outer tub 3 to flow into the accommodating chamber 1 is provided between the cover plate 21 and the outer tub 3. Thus, when the shield cover 2 is lowered to be placed at the drainage outlet 31, the washing water in the outer tub 3 can still flow into the accommodating chamber 1 so as to ensure that the washing water in the outer tub 3 can be entirely discharged away through the drainage outlet 31. At the same time, during the water supply process of the washing machine, the washing water can be firstly introduced into the accommodating chamber 1, generating buoyancy force to the buoyancy chamber 20 to make the shield cover 2 rise.

As shown in from FIGS. 3 to 6, in the present embodiment, the outer periphery of the cover plate 21 is provided with a plurality of supporting ribs 22 extending radially along the cover plate 21, and the support ribs 22 are protrudingly provided from the periphery of the drainage outlet 31. The thickness of the supporting rib 22 is greater than the thickness of the cover plate 21, and the lower side of the supporting rib 22 protrudes from the lower side of the cover plate 21, so that the cover plate 21 is provided at a certain distance away from the drainage outlet 31 under the support of the supporting ribs 22 to form a gap for the washing water flowing into the accommodating chamber 1.

In the present embodiment, the adjacent supporting ribs 22 are spaced at a certain angle, the distance between the adjacent support ribs 22 is smaller than the diameter of the cleaning particles 6. Thus, when the cleaning particles float up with the washing water, the cleaning particles are prevented from rising vertically upward through the drainage outlet to reduce the impact strength of the cleaning particles against the bottom of the inner tub. It is further preferred that the supporting ribs be arranged at equal interval angle.

In the present embodiment, the outer diameter of the cover plate 21 is slightly smaller than the diameter of the drainage outlet 31 so that the washing water can flow vertically into the accommodating chamber directly through the gaps between the adjacent supporting ribs.

As shown in FIG. 3, in the present embodiment, the supporting rib 22 is wedge-shaped, the height of the supporting rib 22 is gradually decreased outwardly from the outer side of the cover plate 21, and the lower side of the supporting rib 22 is inclined; the outer tub portion at the drainage outlet 31 has a tapered surface that is tapered from top to bottom matching with the underside of the supporting rib 22. Thus, the cleaning particles are allowed to flow rapidly into the accommodating chamber with the drain water under the action of the tapered surface to improve the collection efficiency of the cleaning particles.

Embodiment 4

In the present embodiment, the lower side of the cover plate 21 is provided with a projecting part 29, when the cover plate rises, the projecting part 29 is at least partially in the drainage outlet 31 to limit the horizontal position of the cover plate 21. Thus, after being floated, the cover plate 21 is always above the drainage outlet 31 to prevent the cover plate from being washed away by the washing water and cannot fall back to the drainage outlet.

Figure 8:
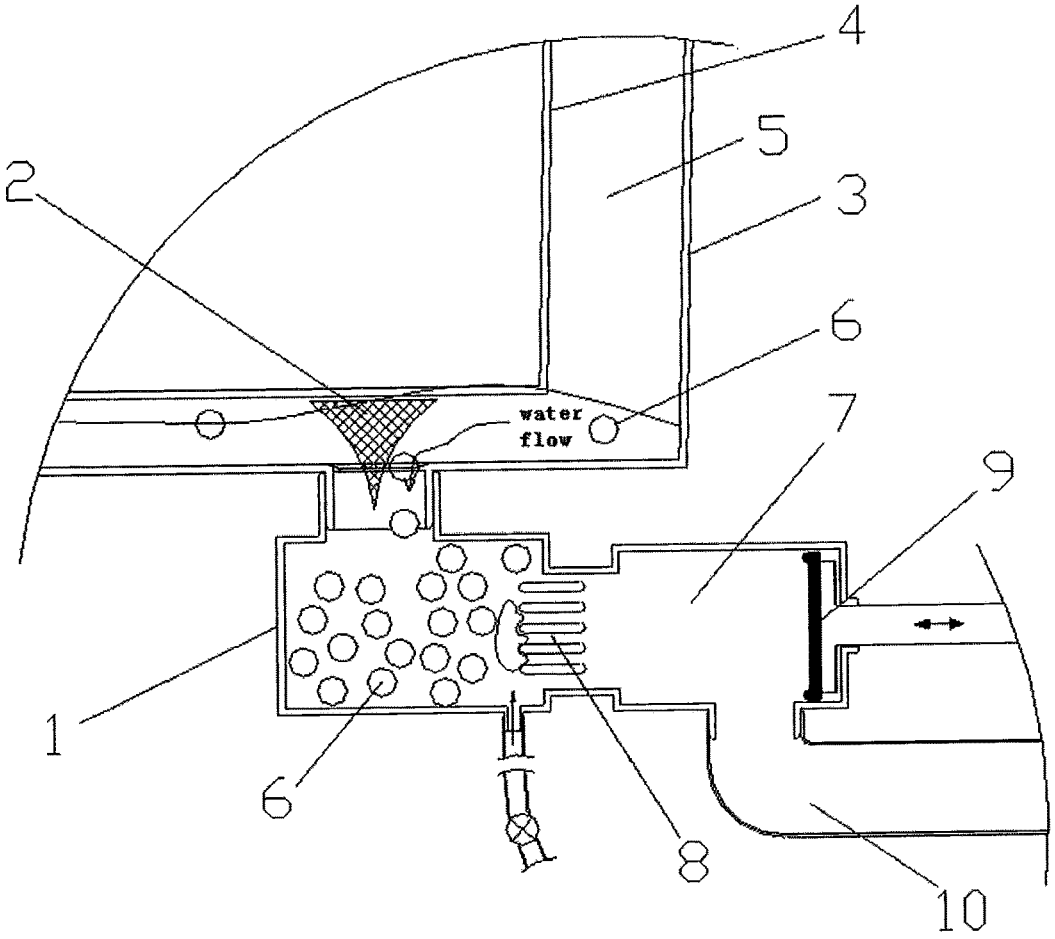
FIG. 8: A structural schematic diagram of a part of a washing machine during washing or rinsing in another embodiment of the present disclosure.
Figure 9:
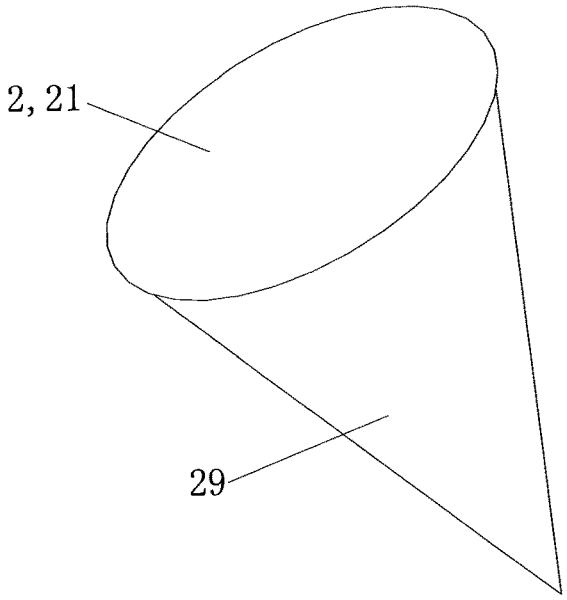
FIG. 9: A structural schematic diagram of the shield cover in another embodiment of the present disclosure.

As shown in FIG. 8 and FIG. 9, the shield cover 2 may be set as a tapered structure, and the upper surface of the tapered structure is the cover plate 21, and the lower surface of the tapered structure is projecting part 29. As shown in FIG. 3, the projecting part 29 may be set as the limit bars 26 projecting downward. In the present embodiment, the height of the projecting part 29 is greater than the distance between the bottom of the inner tub and the bottom of the outer tub to ensure that at least part of the projecting part 29 is in the drainage outlet 31 regardless of whether the shield cover 2 is rising or falling.

It can also be shown in FIG. 3, the lower end of the projecting part 29 is provided with a horizontal projecting buckle 24, the buckle 24 is matched with the drainage outlet 31 and is clamped so that the shield cover 2 is located above the drainage outlet 31 limited by the buckle after floating. And the distance between the buckle 24 and the cover plate 21 is larger than the diameter of the cleaning particles so that the height of the shield cover 2 floating can allow the cleaning particles 6 to pass through the drainage outlet 31. Preferably, the distance between the buckle 24 and the cover plate 21 is less than the distance between the bottom of the inner tub and the bottom of the outer tub to avoid the contact of the floating shield cover 2 with the bottom of the inner tub and to reduce the wear of the inner tub during the washing process.

Figure 6:
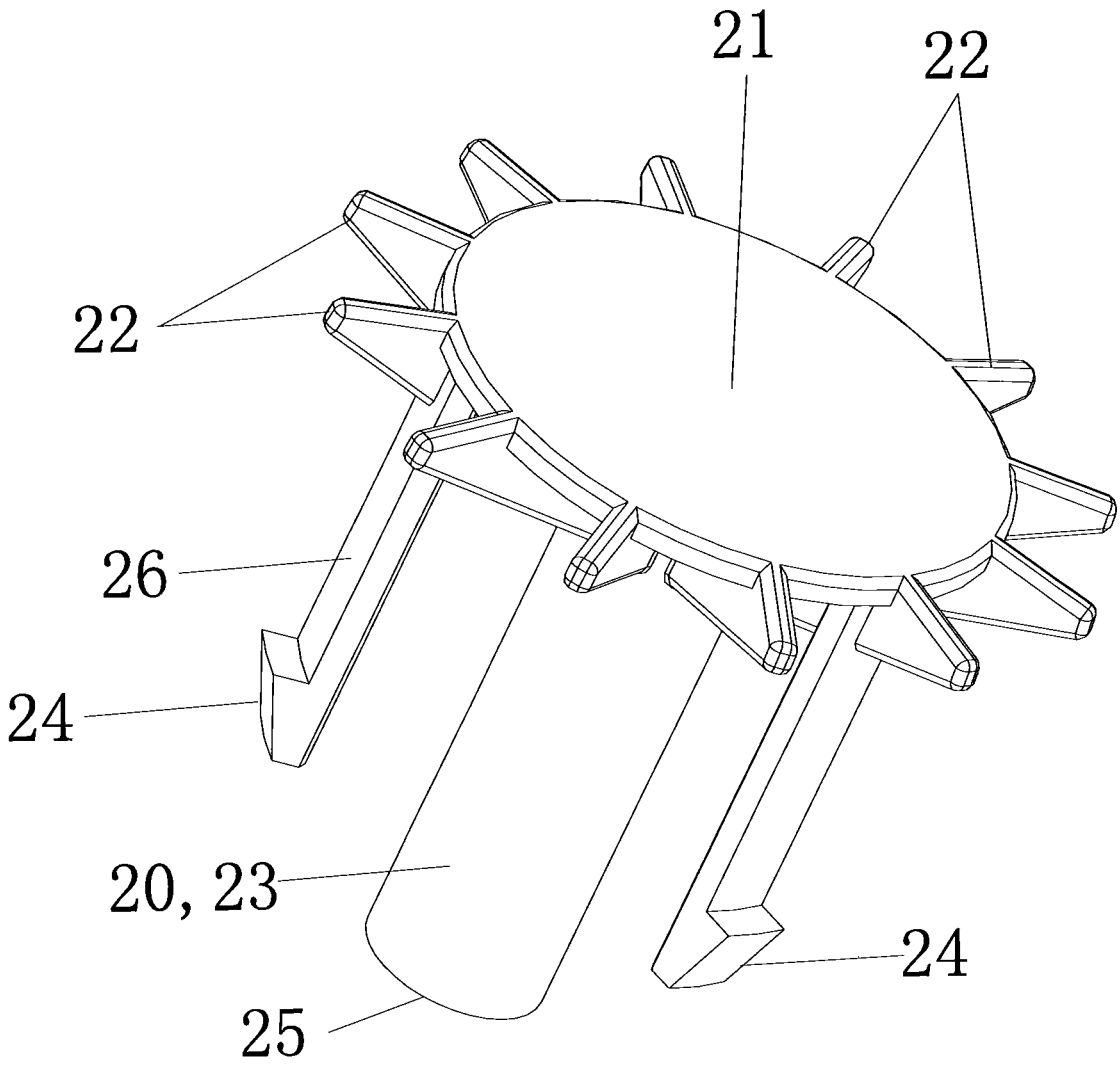
FIG. 6: A structural schematic diagram of the shield cover of the present disclosure.

As shown in FIG. 6, in the present embodiment, the projecting part 29 includes at least two limit bars 26 extending vertically downward below the cover plate 21, and the lower end of the limit bar 26 is provided with an outwardly projecting buckle 24. And the buckle 24 is matched with the outer circumference of the drainage outlet 31 and is clamped, so that the cover plate 21 can be raised by a height relative to the outer tub 3 and the cover plate 21 is horizontally limited above the drainage outlet 31. Preferably, the limit bars 26 is provided closely to the outer circumference of the drainage outlet 31, and each of the limit bars 26 is disposed symmetrically with respect to the center of the cover plate 21, and the buckle 24 is projected radially outwardly along the cover plate 21.

Embodiment 5

Figure 7:
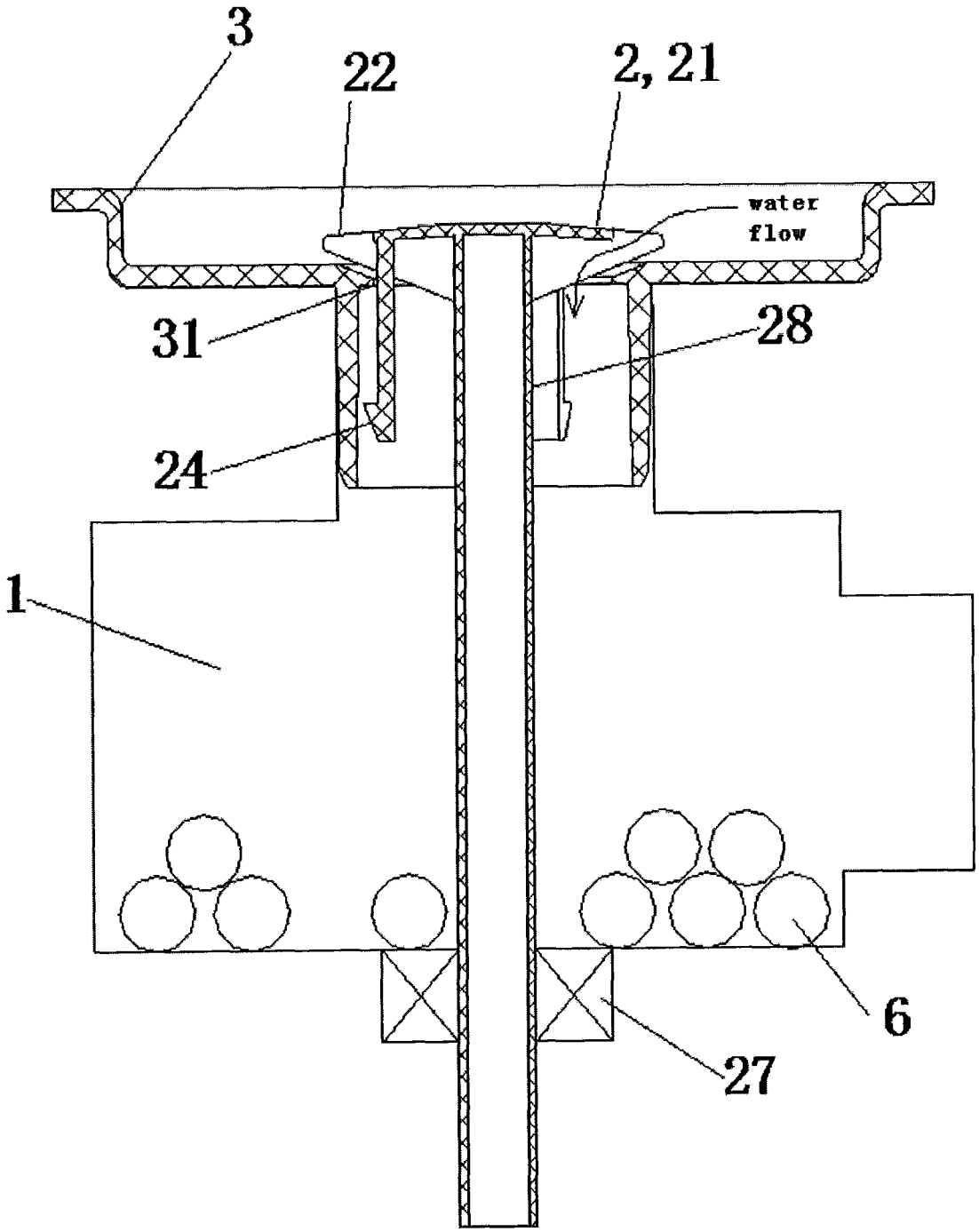
FIG. 7: A structural schematic diagram of a storage device for collecting cleaning particles in another embodiment of the present disclosure.

As shown in FIG. 7, in the present embodiment, the shield cover 2 is connected to a vertical provided screw 28 which is vertically inserted through the accommodating chamber 1, and the upper end of the screw 28 is fixedly connected to the cover plate 21 of the shield cover 2 and the lower end thereof passes through the bottom of the accommodating chamber 1. In the present embodiment, the control motor 27 is provided at the lower portion of the accommodating chamber 1. The output end of the control motor 27 is constituted by a worm wheel provided with an internal thread. The outer peripheral wall of the screw 28 is provided with an external thread (not shown in the drawing) which engages with the worm wheel so that the output end of the control motor 27 and the screw 28 constitute a worm gear structure to realize the rising and falling of the shield cover 2 driven by the rotation of the output end of the control motor 27. With the above arrangement, the purpose of raising or lowering the shield cover under the control of the motor is realized, and it can be avoided that the cleaning particles cannot return to the accommodating chamber because of the shield cover closed when the washing water is discharged all.

Embodiment 6

Figure 2:
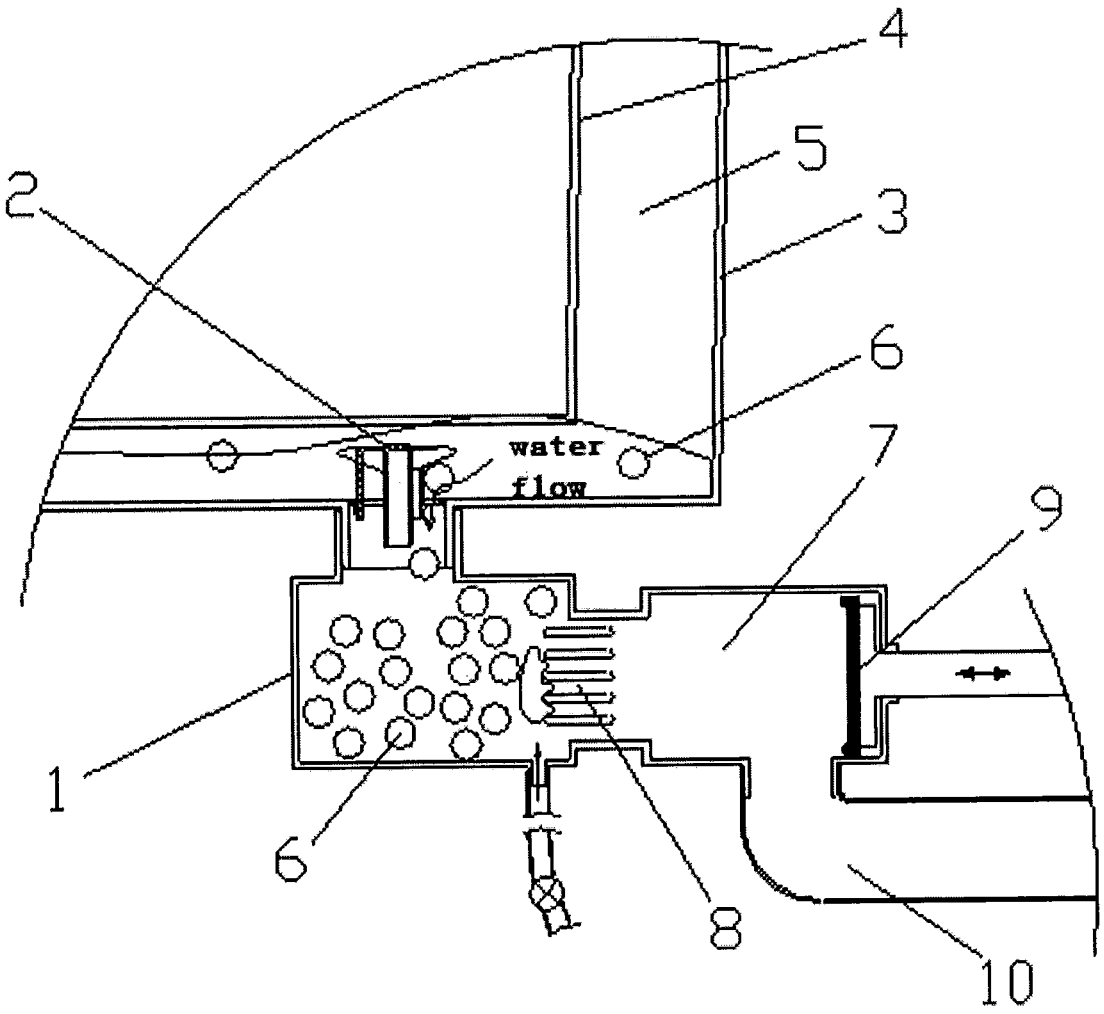
FIG. 2: A structural schematic diagram of a part of a washing machine during washing or rinsing of the present disclosure.

As shown in FIG. 1 and FIG. 2, in the present embodiment, the washing machine also includes drainage device. The drainage device includes a drainage chamber 7 communicating with the accommodating chamber 1, and a drainage valve 9 is installed in the drainage chamber 7, and a water outlet is provided below the drainage chamber 7 which is connected to the drainage pipe 10 of the washing machine, and an overflow pipe connection port is provided above the water outlet. The connection between the drainage chamber 7 and the accommodating chamber 1 is provided with a filtering mechanism 8 for preventing the cleaning particles 6 from flowing out. Preferably, the filter mechanism 8 is comprised of a barrier grid or a grid.

In the present disclosure, the accommodating chamber 1 is provided below the outer tub 3, and the upper wall of the accommodating chamber 1 is provided with a port communicating with the drainage outlet 31 provided at the bottom of the outer tub. As shown in FIGS. 1 and 2, the port, the accommodation chamber 1, and the drainage chamber 7 are communicated in series to form an L-shaped water passage.

Preferably, the upper wall of the accommodating chamber is inclined obliquely upwardly from the periphery toward the port (not shown in the drawings); the inclination causes the cleaning particles to float up to the port as the water level rises and then flow into the chamber between the inner tub and the outer tub through the drainage outlet. During the process of drainage and dewatering, the cleaning particles 6 flow along the draining water into the accommodating chamber. When the water is fed next time, the cleaning particles move upwards as the water level of the accommodating chamber rises, and the cleaning particles will move in the oblique direction, that is, will move obliquely upward, which is more convenient to enter the port, and then into between the inner tub and the outer tub through the drainage outlet.

Embodiment 7

In the present embodiment, during the washing process the cleaning particles can float between the inner tub and the outer tub and impact the walls of the inner and outer tubs along with the water flow. And the walls of tubs are cleaned by the cleaning particles striking and rubbing the walls of the inner and outer tubs. After the cleaning, the cleaning particles flow into the accommodating chamber with draining water during the drainage process. When the water is fed in rinsing or next washing, the cleaning particles float out of the accommodating chamber with the supplied water level rising and flow into between the inner tub and the outer tub.

The cleaning particles are arranged between the inner tub and the outer tub for cleaning the walls of the inner tub and the outer tub, so that it will not stick dirt and breed bacteria. The cleaning particles can be sponge material or rubber or plastic foam, such as foam rubber, foam plastic, foam composite polyurethane. It is preferable to use an adsorbent material for cleaning the tub walls better. The cleaning particles need to have a certain degree of elasticity, a lower density than water in dry state, can be soaked in water, cheap price and strong abrasion resistance.

The cleaning particles are spherical, square, elliptical, cylindrical, tetrahedron or other irregular agglomerated particulate matter, the number of which is 3 to 50, which has lower density than water and a certain elasticity and abrasion resistance.

The embodiments of the above embodiments may be further combined or replaced, and the embodiments are merely illustrative of the preferred embodiments of the invention and are not intended to limit the scope and scope of the invention. It will be understood by those skilled in the art that various changes and modifications in the technical solutions of the present invention are within the scope of the present invention without departing from the design concept of the present invention.

The invention claimed is:

1. A self-cleaning washing machine, comprising an outer tub and an inner tub, a chamber between the outer tub and the inner tub being provided with cleaning particles for cleaning an inner wall of the outer tub and an outer wall of the inner tub;

wherein an accommodating chamber for collecting the cleaning particles is connected to a drainage outlet of the outer tub;

a shield cover is arranged at the drainage outlet, the shield cover rises or falls as a change of a water level in the washing machine or by a control of a control device to open or at least partially close the drainage outlet so that the cleaning particles are controllably flowed into the chamber or flowed back into the accommodating chamber;

the shield cover includes a cover plate covering the drainage outlet; a projecting part is provided under the cover plate, when the cover plate rises, the projecting part is at least partially in the drainage outlet to limit a horizontal position of the cover plate.

2. The self-cleaning washing machine according to claim 1, wherein, a density of the shield cover is lower than a density of washing water so that the shield cover rises as a rise of the water level or falls as a drop of the water level in the outer tub.

3. The self-cleaning washing machine according to claim 2, wherein, a body of the shield cover is provided with or connected with a hollow part which is set independently, the hollow part forms a buoyancy chamber;

the buoyancy chamber is sealed or open only at a lower end, so that the buoyancy chamber is filled with air and provides the floating force for the shield cover when the washing machine washing or rinsing.

4. The self-cleaning washing machine according to claim 3, wherein: the shield cover includes a sleeve with a hollow, a hollow part of the sleeve-constitutes the buoyancy chamber;

the sleeve is arranged under the cover plate, an upper end of the sleeve is sealed and a lower end is open.

5. The self-cleaning washing machine according to claim 1, wherein: a gap for the washing water in the outer tub flowing into the accommodating chamber is arranged between the cover plate and the outer tub and/or at the cover plate.

6. The self-cleaning washing machine according to claim 5, wherein: a supporting rib is arranged at an outer periphery of the cover plate so that the cover plate is supported above the drainage outlet by the supporting rib;

a gap for the washing water in the outer tub flowing into the accommodating chamber is arranged between the cover plate and the outer tub.

7. The self-cleaning washing machine according to claim 6, wherein: adjacent supporting ribs are spaced at a certain angle, a distance between the adjacent support ribs is smaller than a diameter of the cleaning particles.

8. The self-cleaning washing machine according to claim 1, wherein: the shield cover is connected with a screw vertically provided;

the washing machine is also provided with a control motor, an output end of the control motor is engaged by thread with the screw in order to make the shield cover rise or fall as a rotation of the output end of the control motor.

9. The self-cleaning washing machine according to claim 1, wherein: the washing machine also includes a drainage structure, the drainage structure comprises a drainage pipe that is communicated with the accommodating chamber, a connection between the drainage pipe and the accommodating chamber is provided with a filtering mechanism for preventing the cleaning particles from flowing out.

10. The self-cleaning washing machine according to claim 2, wherein, the shield cover includes a cover plate covering the drainage outlet; a projecting part is provided under the cover plate, when the cover plate rises, the projecting part is at least partially in the drainage outlet to limit a horizontal position of the cover plate.

11. The self-cleaning washing machine according to claim 1, wherein, a lower end of the projecting part is provided with a buckle with horizontal projection, the buckle is matched with the drainage outlet and is clamped; a distance between the buckle and the cover plate is smaller than a clearance between a bottom of the inner tub and a bottom of the outer tub, and is larger than a diameter of the cleaning particles.

12. The self-cleaning washing machine according to claim 4, wherein, the sleeve is disposed coaxially with the cover plate, and the sleeve extends vertically.

13. The self-cleaning washing machine according to claim 3, wherein: a gap for the washing water in the outer tub flowing into the accommodating chamber is arranged between the cover plate and the outer tub and/or at the cover plate.

14. The self-cleaning washing machine according to claim 4, wherein: a gap for the washing water in the outer tub flowing into the accommodating chamber is arranged between the cover plate and the outer tub and/or at the cover plate.

15. The self-cleaning washing machine according to claim 6, wherein, the outer periphery of the cover plate is provided with a plurality of supporting ribs extending radially along the cover plate, and the support ribs are protruded from the outer periphery of the drainage outlet; the supporting rib is greater thickness than the cover plate, and an underside of the supporting rib protrudes from an underside of the cover plate, so that the cover plate is provided at a certain distance from the drainage outlet under a support of the support ribs to form a gap for the washing water flowing into the accommodating chamber.

16. The self-cleaning washing machine according to claim 7, wherein, the supporting rib is wedge-shaped, a height of the supporting rib is gradually decreased outwardly from an outer side of the cover plate, and the underside of the supporting rib is inclined; an outer tub portion at the drainage outlet has a tapered surface that is tapered from top to bottom matching with the underside of the supporting rib.

17. The self-cleaning washing machine according to claim 2, wherein: the shield cover is connected with a screw vertically provided;

the washing machine is also provided with a control motor, an output end of the control motor is engaged by thread with the screw in order to make the shield cover rise or fall as a rotation of the output end of the control motor.

18. The self-cleaning washing machine according to claim 1, wherein: the shield cover is connected with a screw vertically provided;

the washing machine is also provided with a control motor, an output end of the control motor is engaged by thread with the screw in order to make the shield cover rise or fall as a rotation of the output end of the control motor.

19. The self-cleaning washing machine according to claim 2, wherein: the washing machine also includes a drainage structure, the drainage structure comprises a drainage pipe that is communicated with the accommodating chamber, a connection between the drainage pipe and the accommodating chamber is provided with a filtering mechanism for preventing the cleaning particles from flowing out.

20. The self-cleaning washing machine according to claim 1, wherein, the shield cover is provided with a buoyancy chamber which is hollow and provides a floating force so that the shield cover rises as a rise of the water level or falls as a drop of the water level in the outer tub.

* * * * *